US007992356B2

(12) United States Patent
Grossman et al.

(10) Patent No.: US 7,992,356 B2
(45) **Date of Patent: *Aug. 9, 2011**

(54) STRUCTURAL ROOF VENTING SYSTEM FOR GRAIN BIN AND ASSOCIATED METHOD

(75) Inventors: Rodney B. Grossman, Goshen, IN (US); Mark S. Dingeldein, Milford, IN (US); Justin Holmes, Valparaiso, IN (US)

(73) Assignee: CTB, Inc., Milford, IN (US)

( * ) Notice: Subject to any disclaimer, the term of this patent is extended or adjusted under 35 U.S.C. 154(b) by 844 days.

This patent is subject to a terminal disclaimer.

(21) Appl. No.: 11/958,899

(22) Filed: Dec. 18, 2007

(65) Prior Publication Data

US 2008/0155909 A1 Jul. 3, 2008

Related U.S. Application Data

(63) Continuation-in-part of application No. 11/268,720, filed on Nov. 7, 2005, now Pat. No. 7,338,359.

(60) Provisional application No. 60/627,918, filed on Nov. 15, 2004.

(51) Int. Cl.
*E04H 7/00* (2006.01)

(52) U.S. Cl. ..... 52/192; 52/198; 52/82

(58) Field of Classification Search ..... 52/192, 52/537, 783.11, 783.14, 783.16, 798.1, 198, 52/82

See application file for complete search history.

(56) References Cited

U.S. PATENT DOCUMENTS

| | | | | | |
|---|---|---|---|---|---|
| 718,657 | A | | 1/1903 | Renton | |
| 1,977,391 | A | | 10/1934 | Kramer | |
| 2,741,972 | A | | 4/1956 | Pryne | |
| 3,092,472 | A | | 6/1963 | Figley | |
| 3,234,700 | A | * | 2/1966 | Creveling | 52/284 |
| 3,324,616 | A | * | 6/1967 | Brown | 52/377 |
| 3,924,367 | A | * | 12/1975 | Stewart | 52/81.4 |
| 3,959,943 | A | * | 6/1976 | Shea et al. | 52/783.14 |
| 4,004,352 | A | | 1/1977 | Steffen | |
| 4,009,520 | A | | 3/1977 | Sukup | |
| 4,020,565 | A | | 5/1977 | Steffen | |
| 4,077,134 | A | | 3/1978 | Steffen | |
| 4,192,107 | A | * | 3/1980 | Wickstrom et al. | 52/82 |
| 4,319,411 | A | | 3/1982 | Steffen | |
| 4,480,534 | A | | 11/1984 | Sloan | |
| 4,498,373 | A | | 2/1985 | Dittmer et al. | |
| 4,625,630 | A | | 12/1986 | Carroll et al. | |
| 4,872,398 | A | | 10/1989 | Shen et al. | |
| 4,885,985 | A | | 12/1989 | Pollock | |
| 4,936,071 | A | * | 6/1990 | Karrfalt | 52/420 |
| 4,955,570 | A | * | 9/1990 | Benz et al. | 248/300 |
| 5,020,246 | A | | 6/1991 | Rust et al. | |
| 5,344,363 | A | | 9/1994 | Pollock | |
| 5,603,657 | A | | 2/1997 | Sells | |
| 5,632,674 | A | | 5/1997 | Miller, Jr. | |
| 6,691,482 | B1 | * | 2/2004 | Ault | 52/450 |
| 6,959,519 | B2 | * | 11/2005 | Adriaansen | 52/537 |

* cited by examiner

*Primary Examiner* — Basil Katcheves
(74) *Attorney, Agent, or Firm* — Harness, Dickey

(57) ABSTRACT

A roof system for a grain storage structure. The roof system includes a plurality of enclosures defined between adjacent roof panel surfaces. Each enclosure includes opposed exterior and interior wall segments oriented at an angle relative to the panel surfaces. The exterior and interior wall segments have cooperating indents that are fastened to one another to secure adjacent roof panels against relative movement.

20 Claims, 11 Drawing Sheets

STRUCTURAL ROOF VENTING SYSTEM FOR GRAIN BIN AND ASSOCIATED METHOD

CROSS-REFERENCE TO RELATED APPLICATIONS

This application is a continuation-in-part of U.S. patent application Ser. No. 11/268,720, filed on Nov. 7, 2005, which claims the benefit of U.S. Provisional Application No. 60/627,918, filed on Nov. 15, 2004. The disclosures of the above applications are incorporated herein by reference.

FIELD

The present disclosure relates to storage containers of bulk granular material, and in particular, to grain bin roofs.

BACKGROUND

The statements in this section merely provide background information related to the present disclosure and may not constitute prior art.

Harvested grain may be dried and stored for extended lengths of time in grain silos or grain bins, because of fluctuating market conditions. Additionally, moist grain may be held in bins and then heated with forced air to extract the moisture. Grain bins typically include a cylindrical body and a conical roof. The body can be a peripheral wall typically comprised of bolted or welded, smooth or corrugated wall panels. The conical roof can have a 20-40 degree slope, and is typically comprised of pie-shaped or radial roof panels with integrated ribs or stiffeners along the two long sides of the panels. These ribs provide strength and stiffness to the panels, allowing them to span between the storage structure's walls and a fill hole collar or to intermediate structural elements located beneath or above the panels.

Grain is typically loaded into these structures through a fill hole at the top of the roof and unloaded via an under floor auger system accessed through operable floor sumps. Because grain may be stored for a relatively long time, methods for preserving the condition of the grain against moisture, temperature, and insects are used. To aid in preserving grain against moisture, grain storage structures typically employ an under floor aeration system, utilizing fans which distribute air horizontally through a plenum space, vertically through a perforated floor into the grain mass, and out through vents located in the roof of the structure. For this function, the roof vents provide a critical outlet for the created pressure, the absence of which could result in excessive stress and damage to the roof structure and containment of moisture limiting the effectiveness of the grain bin. To aid in preserving grain against the negative effects of high ambient air temperatures that tend to occur at the inside peak of the roof, roof vents are again utilized, relieving the build-up of hot air by means of natural convection.

While roof venting is desired and even necessary during some processes of conditioning grain, roof vents can be detrimental in other processes. Grain must also be preserved against insects, which can enter the storage structure as larvae during loading, or as flying insects through vent screens. The typical method to remedy this problem is fumigation of the storage container. This process is performed within the container and requires that the container be reasonably airtight. Roof vents must be sealed in some way prior to fumigating, a process that can take substantial time and often poses some safety risk. In addition to the fumigation process, roof vents also must often be closed during the grain loading process. During grain loading, substantial grain dust is generated which can escape through roof vents and settle on surrounding structures. Many municipalities require that grain storage facilities located within town limits prevent the migration of grain dust during loading.

Typically, roof venting systems include a series of roof panels located at regular radial intervals, with a single hole cut in the flat portion between the integrated ribs, and capped with a metal shroud which allows air to escape while preventing rain or snow from entering into the container. The metal shrouds are comprised of multiple parts and are fastened to the roof panel in the field during the construction of the storage structure. The number and frequency of vented panels varies based on the container's capacity, fan output, climate, and other venting requirements. Because of the size of the vent hole and shroud, the pie shape of the roof panels, and the natural convergence of the integrated ribs towards the top of the container's roof peak, the vent hole in the vented panels is typically located in the end of the panel nearest to the container's wall. This location is not ideal, as the heated air that desires relief by natural convection, is located at the peak of the roof, not the eave.

Existing vents can be expensive and time-consuming to install, can often leak because of difficulties in installation, can trap material, and can lead to rusting around the vents. There is, therefore, a need for improved venting systems for grain bins.

SUMMARY

The present teachings provide a vented roof support system for a granular storage structure. The roof system includes a plurality of interconnected radial support members defining at least a portion of a roof. Each support member comprises a trapezoidal shaped monolithic sheet of structural metal formed having first and second spaced-apart rail members radially extending and integrally connected by a center panel member. Each rail member comprises a plurality of indents formed therein. Rail members of adjacent support members cooperate to overlap with one another such that indents of neighboring support members are aligned to be fastened together to space the rail members from each other, forming a radially extending structural stiffener.

In another aspect, the present teachings provide a radial roofing system comprising a granular storage bin having an upper rim. A plurality of individual radial roof support members are configured to rest adjacent the upper rim. Each radial roof support member is formed from a folded, monolithic sheet of structural metal and has a first rail member having a first plurality of indents and a second rail member having a second plurality of indents. A center panel is disposed between the first rail member and the second rail member. Adjacent roof support members are arranged in a 180 degree relationship to one another. A plurality of the respective first and second pluralities of indents of neighboring rail members are fastened together to space the rail members from each other, forming a structural stiffener therebetween. The structural stiffeners radially extending a length of the roof support members.

The present teachings also provide a method for constructing a vented roof system for a granular storage structure. The method comprises providing a unitary flat sheet of structural steel and defining a plurality of indents and apertures within the sheet to form a blank. A plurality of blanks are then shaped and formed into roof support members, each having first and second spaced-apart rail members integrally connected by a center panel member. The method includes overlapping adjacent roof support members in a 180 degree relationship to one another and aligning the rail members to form a plurality of enclosures defined between adjacent center panel members. Each enclosure comprises opposed outer and inner wall portions oriented at an angle relative to the center panel. The outer and inner wall portions include the plurality of indents and apertures configured for providing fluid communication between an interior of a structure and the ambient environment. The respective indents of adjacent rail members are aligned with one another and adjacent roof support members are secured together.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 9:
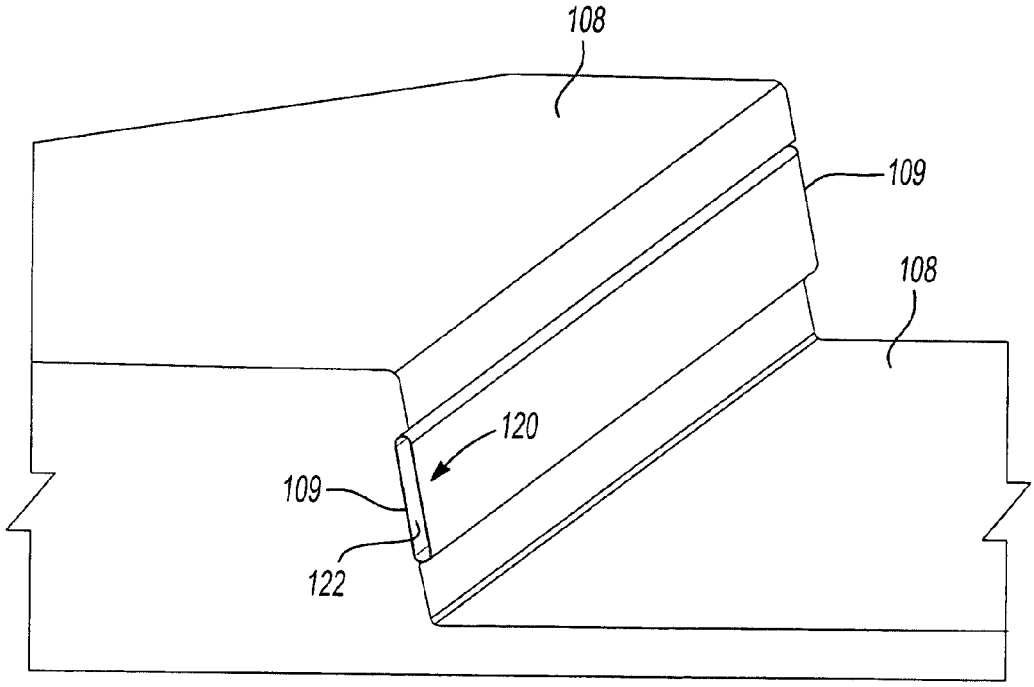
Figure 10:
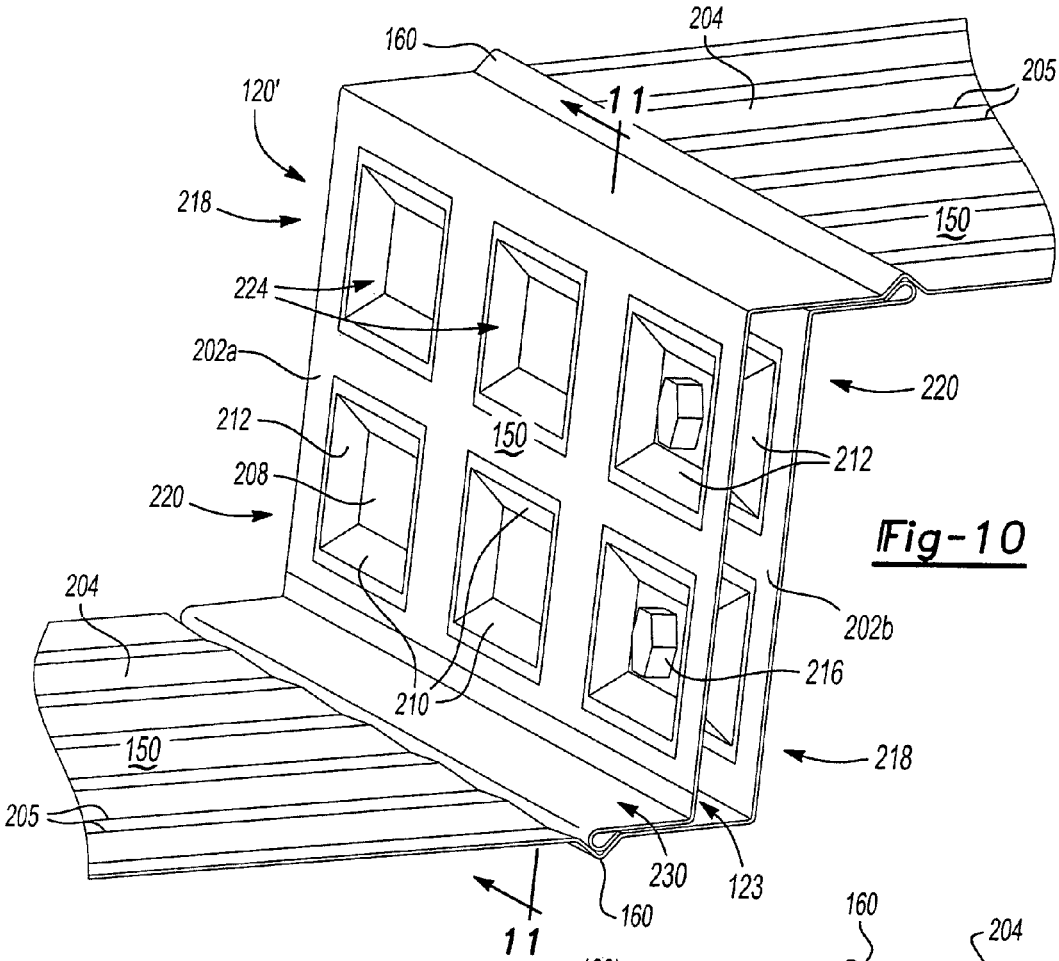
Figure 11:
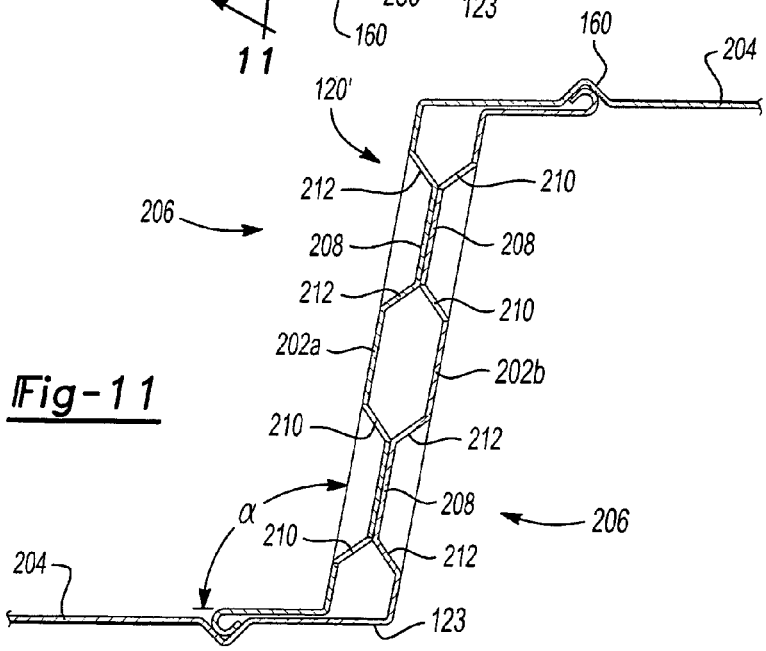
Figure 12:
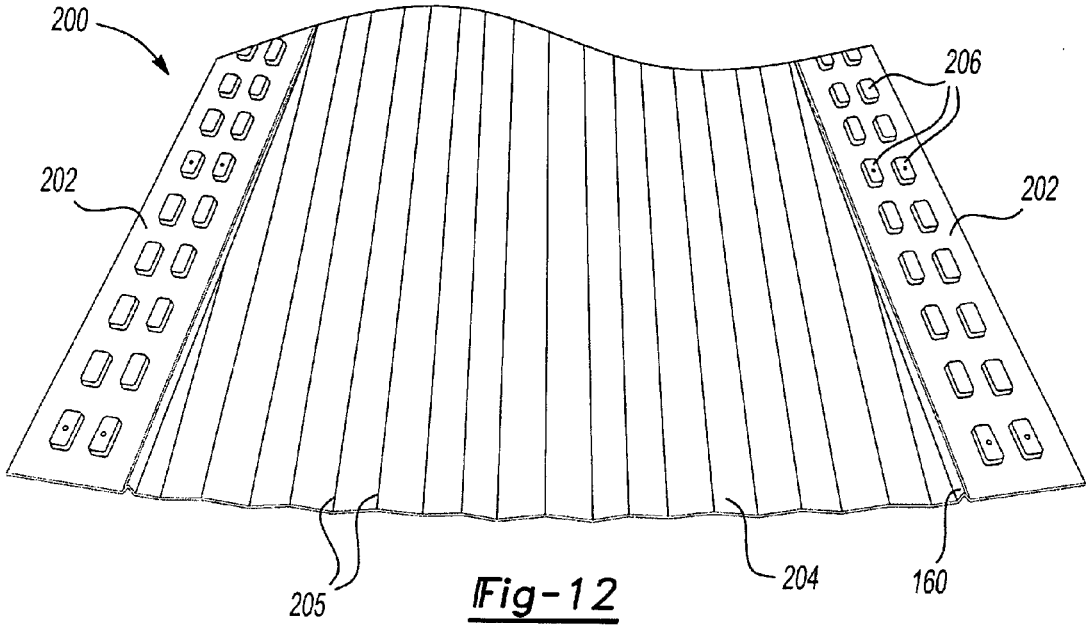
Figure 13:
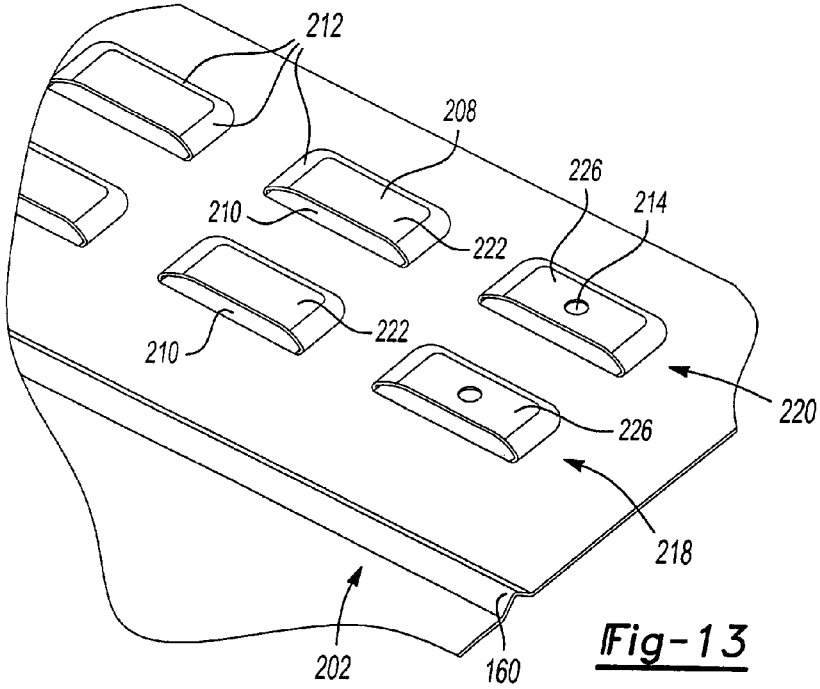
Figure 14:
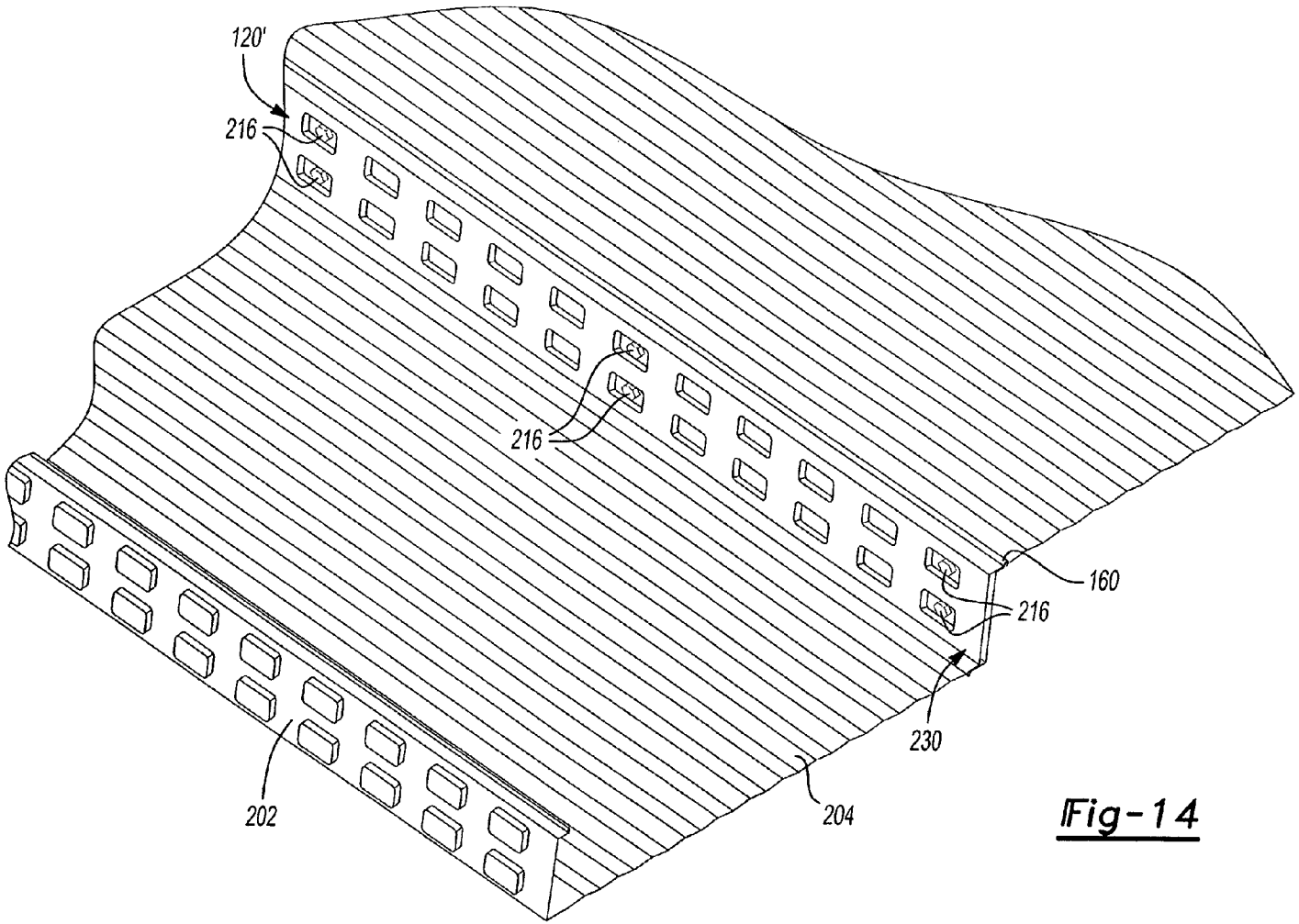
Figure 15:
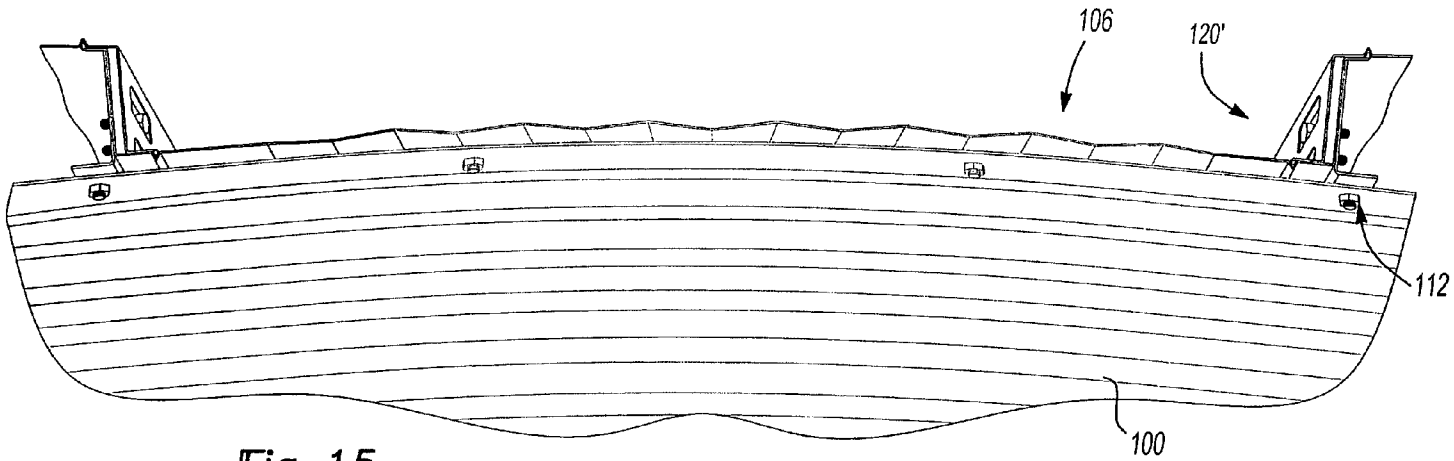
Figure 16:
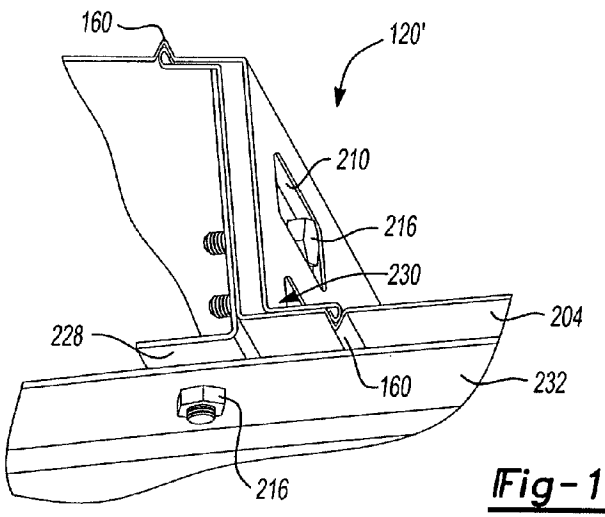

FIG. 9 a perspective view of a stiffener according to the present teachings;

FIG. 10 is perspective view of a stiffener integrated with indents and a venting system according to the present teachings;

FIG. 11 is a partial cross-sectional view of FIG. 10 taken along the line 11-11;

FIG. 12 is a perspective view of a roof support member blank according to the present teachings;

FIG. 13 is a partial magnified view of FIG. 12 illustrating indents and vents;

FIG. 14 is a perspective view of two neighboring roof support members overlapping one another in a 180 degree relationship;

FIG. 15 is a side view of an eave area of granular storage container illustrating the roofing system attachment according to the present teachings; and FIG. 16 is a partial magnified view of FIG. 15.

DETAILED DESCRIPTION

The following description is merely exemplary in nature and is not intended to limit the present disclosure, application, or uses. For example, although a grain bin is illustratively described, the present teachings are not limited to grain bins, but can be used for any storage containers of bulk granular material. It should be understood that throughout the drawings, corresponding reference numerals indicate like or corresponding parts and features.

Figure 1:
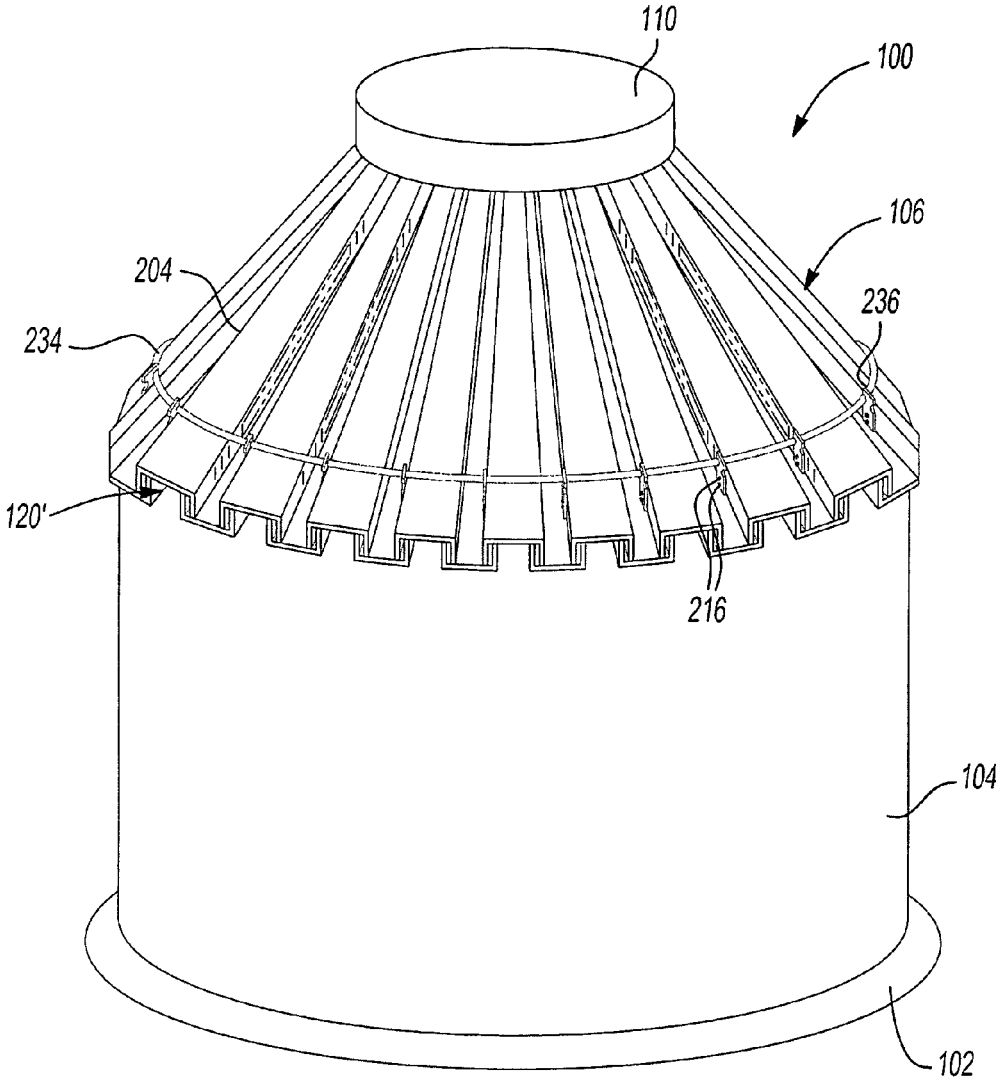
FIG. 1 is a perspective view of a grain bin with a roof system according to the present teachings.

Referring to FIG. 1, an exemplary granular material storage container 100 according to the present teachings, illustrated as a grain bin, may include a foundation 102, a wall 104 having an upper periphery or eave 112, and a roof system 106 extending from a peak 110 to the upper periphery 112. The roof system 106 can be substantially conical and can include a plurality of radial panels 108 extending from the peak 110 to the upper periphery 112, a plurality of a radial stiffeners 120, and a plurality of vents 130. The radial stiffeners 120 can be integral with the panels 108, and the vents 130 can be integral with the stiffeners 120.

Figure 2A:
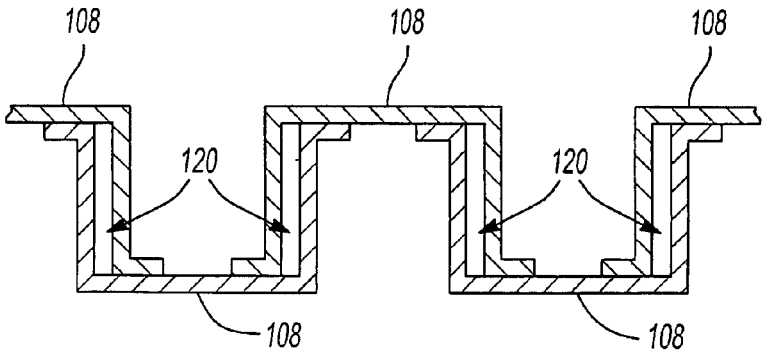
FIG. 2A is a schematic partial side view of roof system according to the present teachings showing a meandering panel arrangement.
Figures 2, 3:
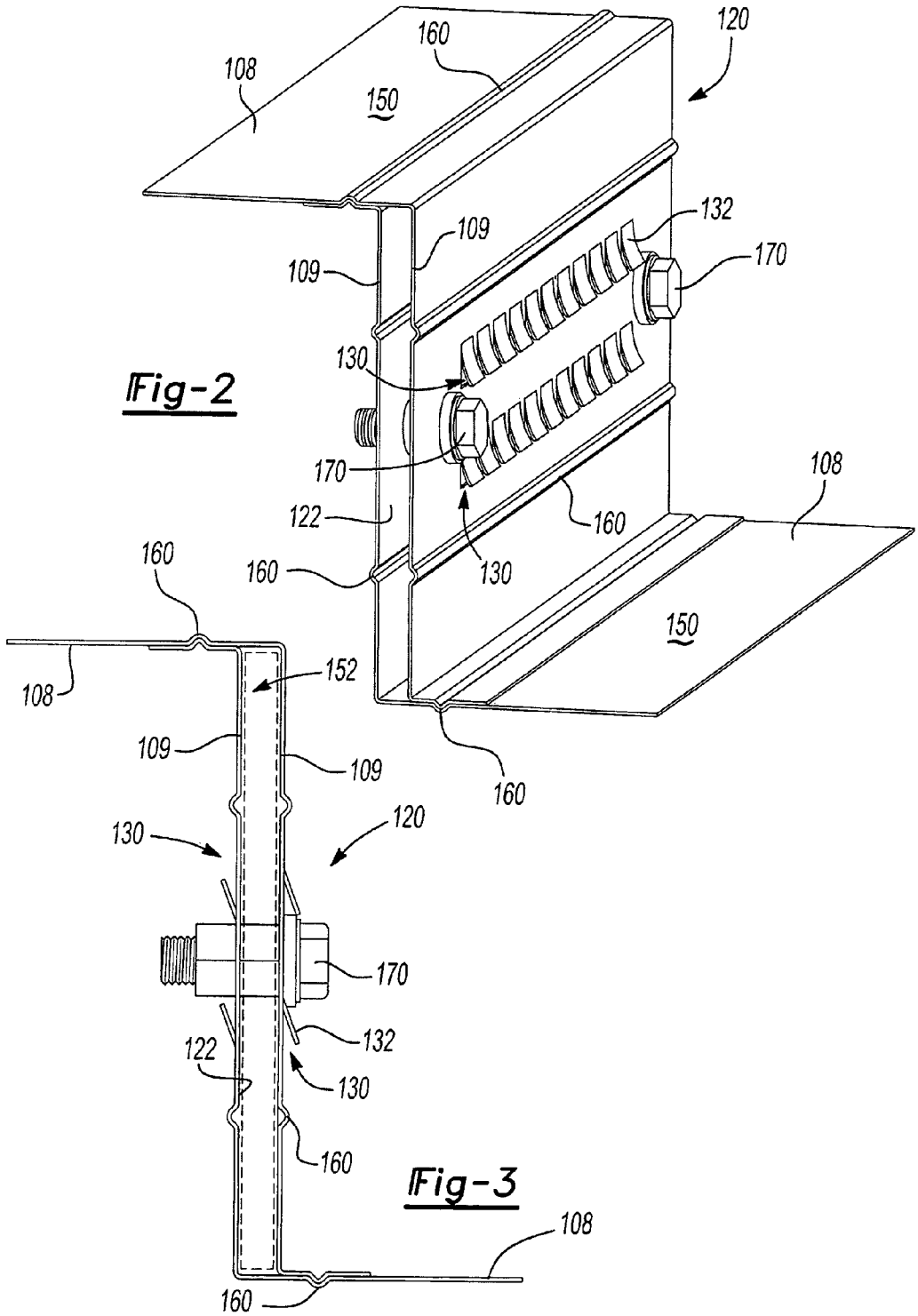
FIG. 2 is a perspective view of a stiffener integrated with a venting system according to the present teachings.
FIG. 3 is a side view of a stiffener integrated with a venting system according to the present teachings.
Figure 5:
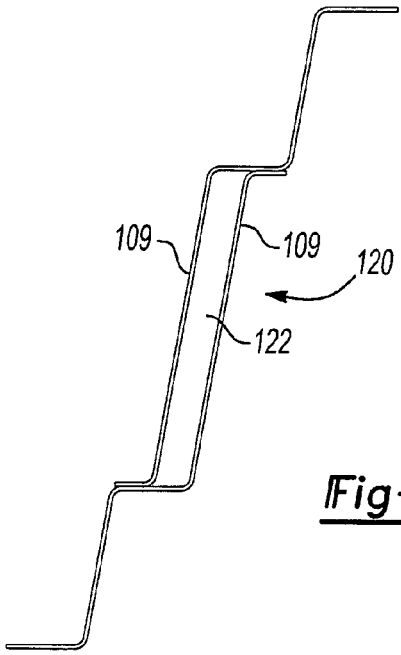
FIG. 5 is a side view of a stiffener according to the present teachings.

Referring to FIGS. 2 and 3, an exemplary pair of adjacent panels 108 can include overlapping opposed exterior and interior wall segments 109 defining a stiffener 120. The overlapping wall segments 109 can be secured against movement at various intervals with bolts or other fasteners 170. The overlapping wall segments 109 can be oriented at an angle, such as a substantially 90 degree angle, relative to surfaces 150 of the panels 108. The stiffener 120 defines a load-bearing structural enclosure 122 in the form of a chamber or enclosed channel. The enclosure 122 is at least in part defined by the two exterior and interior wall segments 109. It will be appreciated that the enclosure 122 can be box-like and have corners that define angles other than 90 degrees, and that the corners can be sharp or rounded. The enclosure 122 can extend along the entire length and width of the overlapping wall segments 109 between the panels 108, as illustrated in FIGS. 2 and 3. In another aspect, the overlapping wall segments 109 can be formed such that the enclosure 122 can occupy only a portion of the width thereof, as illustrated in FIGS. 5 and 9.

Figure 8:
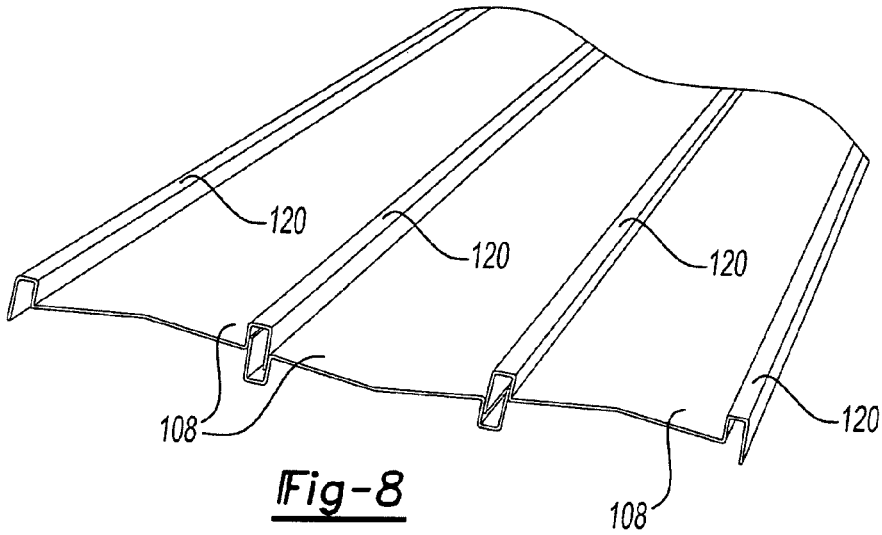
FIG. 8 is a perspective view of a portion of a roof system according to the present teachings.

Adjacent panels 108 can overlap such that the stiffeners 120 extend at an angle between unequally leveled adjacent panel surfaces 150, such that the panels 108 form a meandering surface, as illustrated in FIGS. 2 and 2A. The stiffeners 120 can also be defined to be centered about equal level adjacent panel surfaces 150, as illustrated in FIGS. 8 and 6.

Figure 3A:
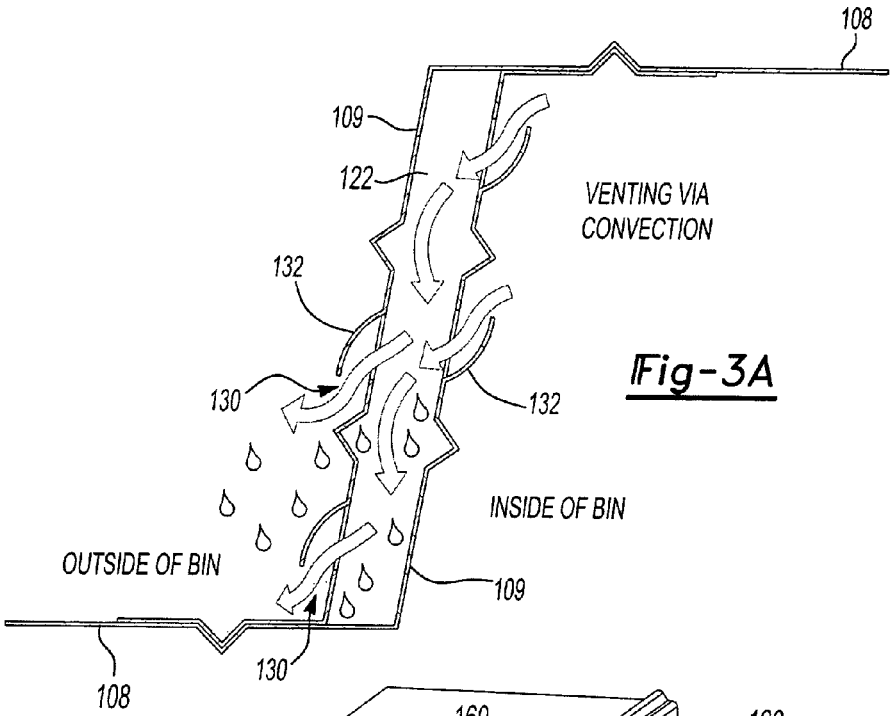
FIG. 3A is a side view of a stiffener integrated with a venting system according to the present teachings.
Figure 4:
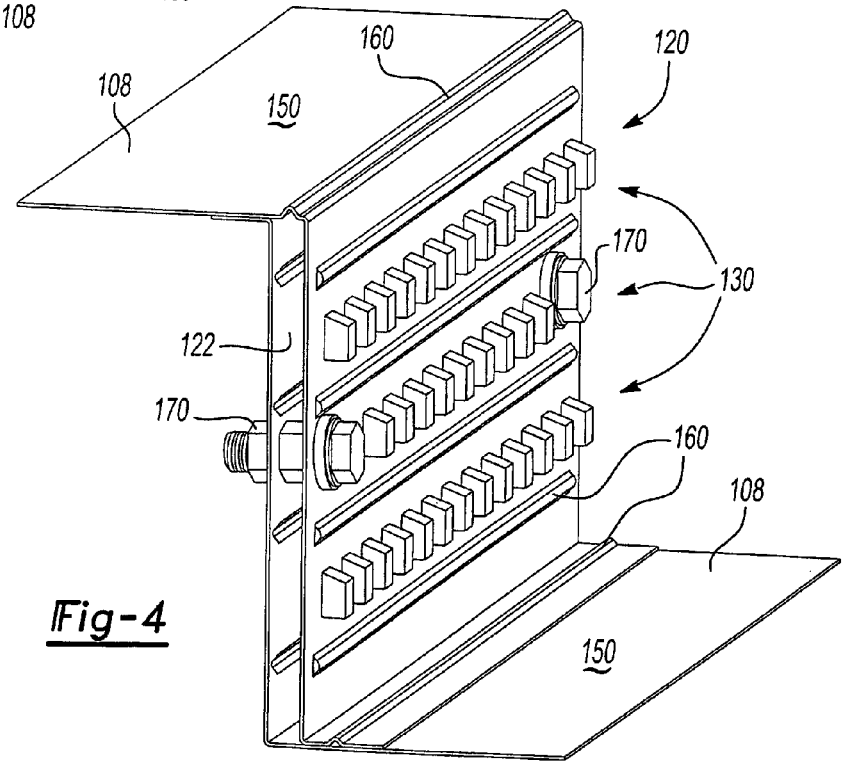
FIG. 4 is a perspective view of a stiffener integrated with a venting system according to the present teachings.

Referring to FIGS. 2-4, a venting system comprising a plurality of vents 130 can be integrated with the stiffeners 120. In particular, the opposed exterior and interior wall segments 109 of the enclosure 122 can define vents 130 with openings having flaps or louvers 132. The louvers 132 of one of the wall segments 109 can be offset relatively to the louvers of the other of the wall segments 109, as illustrated in FIG. 3A. The louvers 132 can be configured such that a substantially one-way venting path, illustrated by arrows, is defined from the interior of the storage container 100 through the enclosure 122 to the exterior of the storage container 100. Further, the louvers 132 can be configured such that moisture from the interior is trapped into the enclosure or led outside the storage container 100, and is prevented from re-entering the interior of the storage container. The louvers 132 can be configured, for example, as moisture collectors facing toward the roof ceiling in the interior of the storage container 100, and as moisture deflectors facing in the opposite direction in the exterior of the storage container 100, as illustrated in FIG. 3A. The vents 130 can be arranged serially in one or more rows along the length (radial extent) of the stiffeners 120.

Figure 4A:
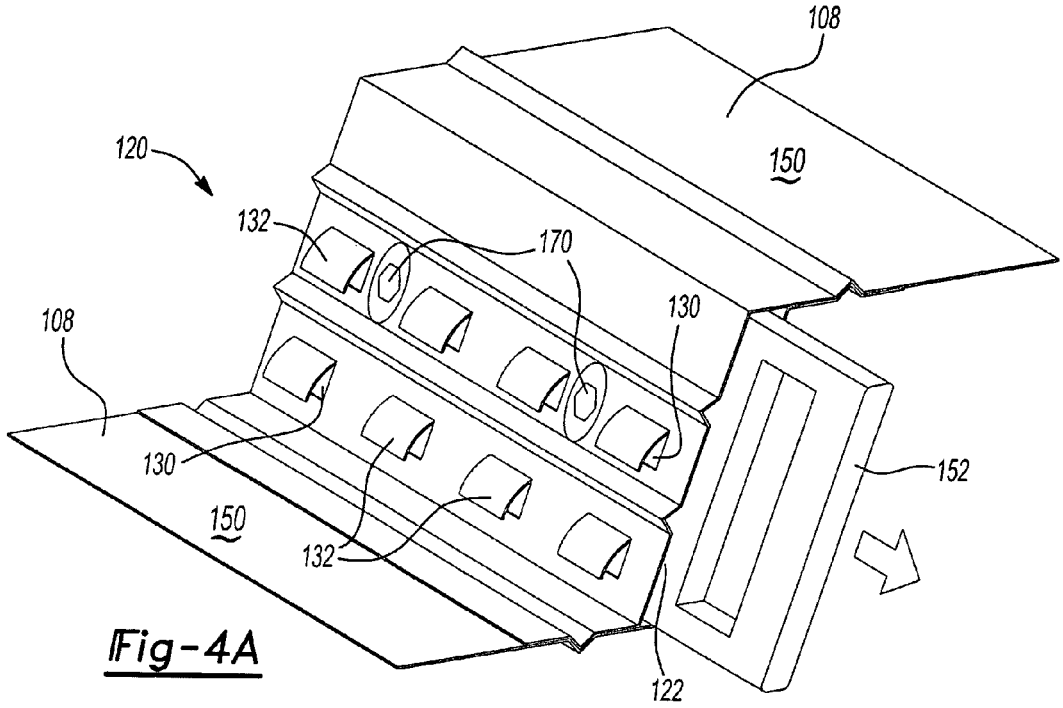
FIG. 4A is a perspective view of a stiffener integrated with a venting system according to the present teachings, the venting system shown in an open position.
Figure 4B:
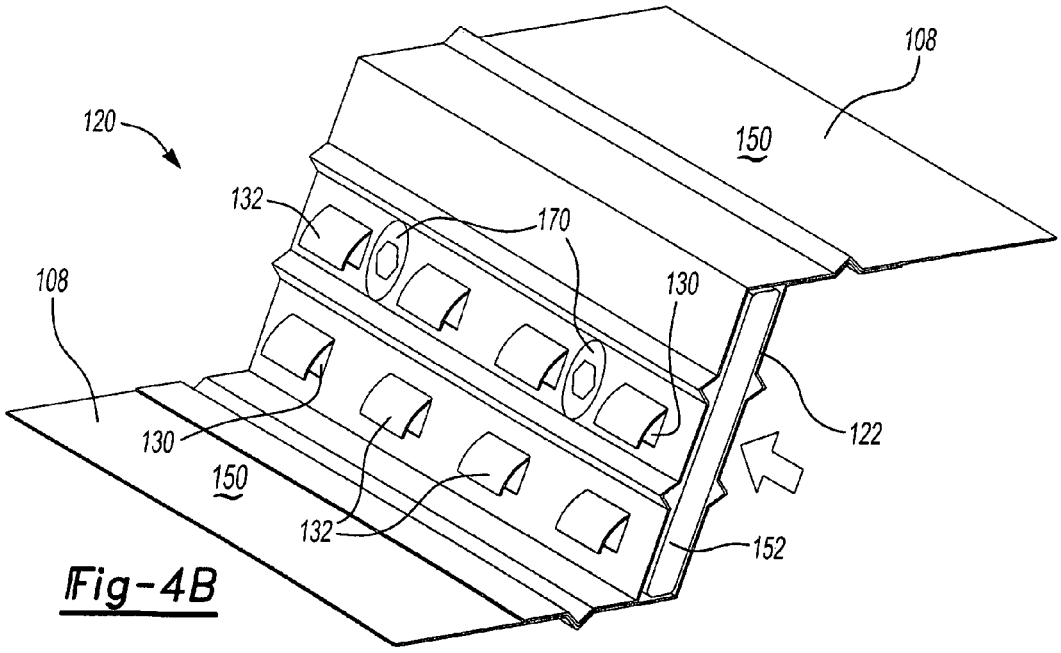
FIG. 4B is a perspective view of a stiffener integrated with a venting system according to the present teachings, the venting system shown in a closed position.

Referring to FIGS. 4A and 4B, a sliding element 152 can be housed inside the enclosure 122 and slidably moved between a first position in which the vents 130 are open and a second position in which the vents 130 are closed. The sliding element 152 can be provided with openings of equal spacing and alignment to the openings of the vent 130 along the length of the stiffeners 120. Each sliding element 152 can be moved parallel to the corresponding stiffener 120 for blocking the vent openings, thereby closing the vents 130 and sealing the grain bin 100. This operation can be performed from a single location, such as the roof peak 110, or from a remote ground location.

Figure 6A:
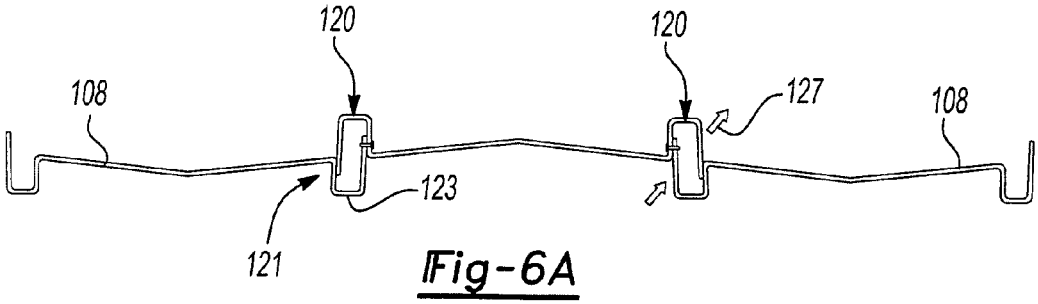
FIG. 6A is a schematic diagram of moisture and air flow details for a roof system according to the present teachings.
Figure 6B:
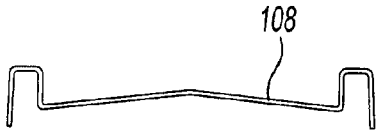
FIG. 6B is a schematic diagram of stiffening details for a roof system according to the present teachings.

In another aspect, referring to FIG. 6A, the panels 108 can be shaped to channel water away from weak joints 121 in the stiffeners 120. A weep pan 123 can provide escape for infiltrating moisture. The folded and corrugated style of the panels 108 can provide additional stiffness, as illustrated in FIG. 6B. Air flow through the stiffeners 120 is indicated at 127.

Figure 7A:
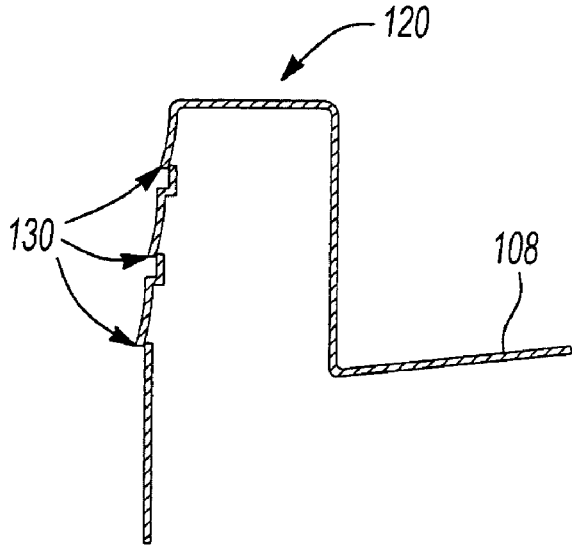
FIG. 7A is a schematic diagram of venting details for a roof system according to the present teachings.
Figure 7B:
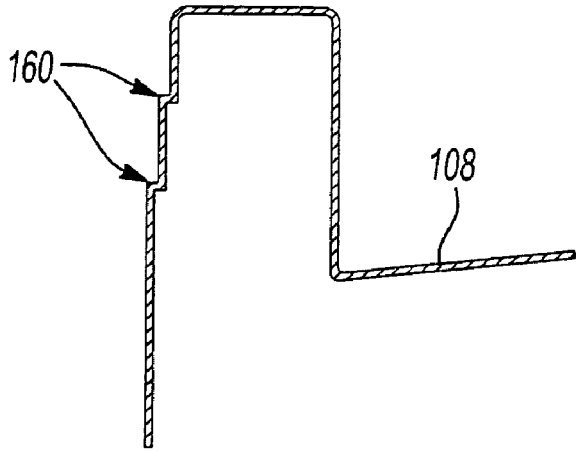
FIG. 7B is a schematic diagram of stiffening details for a roof system according to the present teachings.

Referring to FIG. 7A, in another aspect the vents 130 can be formed with hawk-cut air inlets/outlets along the length of the stiffener 120. Small corrugations 160 can also be provided to increase strength as illustrated in FIG. 7B.

Accordingly, the panels 108 of the roof system 106 integrate structural load-carrying double-walled stiffeners 120 defining an enclosure 122 between opposed exterior and interior walls 109, and an air venting system with air vents 130 having offset louvers 132 and a vent closing sliding element 152. The vents 130 can be arranged such that airflow occurs through the vents 130 along the entire length of the stiffeners 120. Further, the vents 130 can be arranged such that the venting area increases linearly from the eave 112 to the peak 110 of the roof system 106. The vents 130 can be configured such that moisture from the top of roof system 106 is prevented from passing through the vents 130.

The double-walled structural stiffeners 120 can be arranged to create a chamber-like enclosure 122 in which the operable vent closing sliding element 152 is housed. Moisture/condensation may be channeled off away from the interior roof system 106 through the chamber 122. The sliding element 152, which is optional, can be used to close the vents 130 and prevent grain dust migration and seal grain bin or silo during insect fumigation process.

It will be appreciated that the double-walled stiffeners 120 with their box-like enclosures 122 provide increased strength for fixed use of material, thereby improving the efficiency of the roof system 106. The overlapping interior and exterior wall segments 109 with the offset louvers 132 prevent moisture infiltration into the storage container 100 from blowing rain or snow. Further, any moisture blown into the enclosure 122 is trapped into the enclosure 122, migrates down the roof panels 108 and exits at the eave 112.

In another aspect, referring now to FIGS. 10-14, the plurality of interconnected radial support members 200 may each comprise a substantially trapezoidal shaped monolithic sheet of structural metal that is stamped or embossed having a variety of configurations. For example, as shown in FIG. 12, the radial support member is formed having first and second spaced-apart rail members 202 radially extending and integrally connected by a center panel member 204. The center panel member 204 may be provided with a plurality of radial or longitudinal corrugations 205 that may serve to provide additional strength and support to the roofing system. Each rail member 202 may comprise a plurality of indents 206 formed therein, as best shown in FIG. 13.

According to various aspects, the rail members 202A, 202B of adjacent shaped support members 200 may cooperate to overlap with one another in a 180 degree relationship such that indents 206 of neighboring support members 200 are aligned with one another at a plurality of generally planar connecting sites 208. The respective indents 206 may then be fastened directly against one another to form the radially extending structural stiffener 120', or enclosure without the need for a separate spacer component.

According to various aspects of the present disclosure, a plurality of the indents 206 may each define at least one venting aperture 210 therein. The indents 206 may be formed using typical embossing, stamping, and cutting techniques as are individually known to those skilled in the art. The depth of the stamping or embossment is generally determined by the relative material thickness. Non-limiting design considerations that may be taken into account to minimize tear or other damage include the material properties, the number and location of vent apertures 210 and fastening apertures 214, and the potential stress or strain that may be applied to the roof structure.

Such indentations can be formed having a wide variety of cross-sectional areas, such as an isosceles trapezoid or convex quadrilateral as shown. In such instances where the indents have a frusto-pyramidal shape, the indents are formed having four side walls 212 and a connecting site 208. Certain of the side walls 212 may be cut or punched out to serve as venting apertures 210. As understood to those skilled in the art, numerous geometrical combinations may be used. For example, the indents 206 may be generally frusto-conical in shape (not shown), still having a planar connecting site 208 at the point where the apical portion of the cone would be removed, however, there would not be any clearly defined side walls. In such a design, venting apertures may be stamped in various locations of the frusto-conical surface to allow for sufficient air flow therethrough.

As shown in FIG. 13, a plurality of the planar connecting sites 208 may be provided with an aperture 214 sufficient to allow a mechanical fastener 216, such as a screw, bolt, rivet, or toggle, to be used to mechanically fasten the neighboring rail members 202 to one another. It may be desired to provide most connecting sites with an aperture 214 wherein those not being used with a fastener could alternatively be used as additional venting apertures. In other aspects, at least some of the indents may be provided with cooperating interlocking members that secure the adjacent rail members 202 and roof support members against relative movement.

As previously discussed above, the interconnected radial support members 200 may cooperate to define a continuous, meandering, exterior roof surface 150 as shown in FIGS. 10-11. In various aspects, the rail members 202 may be shaped, formed, and oriented having an angle $\alpha$ of between about 90 to about 110 degrees relative to the center panel member 204. For ease of assembly, each of the interconnected radial support members 200 may be substantially similar in shape to each other after being stamped and formed. As should be understood by those skilled in the art, depending upon the overall design considerations, it is also understood that the roofing system may include radial support members having more than one specific shape or embossed design. For example, certain of the rail members 202 may be provided with at least two rows 218, 220 of spaced apart indents 206. Accordingly, there may also be various combinations of venting indents 222, non-venting indents 224, and fastening indents 226 that cooperate to secure neighboring rail members 202 together.

For example, it may be desirable to provide a first row 218 of venting indents 222 and a second row 220 of non-venting indents 224 as shown in FIG. 10. The fastening indents 226 can be vented or non-vented, with non-vented indents providing additional structural support. Identical adjacent roof support members 200 may be arranged in a 180 degree relationship to one another to form enclosed structural stiffeners 120', wherein respective fastening indents 226 of neighboring rail members 202 are fastened to one another.

In FIG. 10, the structural stiffener 120' may be provided with an inner wall portion 202B facing an interior of the granular storage container, an outer wall portion 202A facing an exterior of the granular storage container, and a base portion, or weep pan 123. This base portion 123 may serve to support the structural stiffener 120' on the upper rim of the granular storage container 100 and is configured to direct moisture to an exterior of the container via the eave area 112. In this manner, the rows 220 of venting indents 222 can be positioned as the upper row in the interior of the granular storage container 100 and the lower row of the exterior of the granular storage container 100. As specifically shown in FIG. 10, non-venting indents 224 may be provided in the lowermost row of indents where the fasteners 216 are attached.

According to other aspects, and as particularly illustrated in FIGS. 12-13, the rail member 202 may be provided with a plurality of identical indents 206. For example, each of the indents 206 may comprise at least one venting aperture 210 and the interconnected radial support members 200 are substantially similar in shape to each other. As illustrated in these figures, the vents can be arranged at the top of the indents, which can reduce the potential for water to enter from the exterior of the granular storage container 10.

FIG. 15 illustrates a side view of an eave area 112 of a granular storage container 10 and best shows the roofing system attachment to the remainder of the grain bin 100. FIG. 16 is a partial magnified view of FIG. 15 where an optional mounting bracket 228 may be used to fasten the structural stiffener 120' adjacent the upper rim 232 of the container 100. In certain aspects, the mounting bracket 228 may provide a small gap area between the upper rim 232 and the structural stiffener 120'. Using this design may minimize the risk that excess moisture will accumulate at the lower inner corner regions 230 of the roof 106. The mounting brackets 228 may be attached using mechanical fasteners 216 of the various interior fastening indents 226 and can be configured to secure the structural stiffeners 120' to the grain bin such that the base portion 123 is elevated a predetermined distance above the upper rim 232. Alternatively, the mounting bracket 228 may couple the structural fastener 120' directly against the upper rim 232 of the container 100.

With renewed reference to FIG. 1, the roofing system may also include a support rod 234 that is circumferentially disposed about the exterior of the roof 106. Such a support rod 234 may be attached to certain of the structural stiffeners 120' using mounting brackets 236 as shown. The mounting brackets 236 may be attached to various exterior fastening indents using mechanical fasteners 216.

The present teachings also provide a method for constructing a vented roof system 106 for a granular storage structure 100. With reference to FIGS. 12-13, the method includes starting with a unitary flat sheet of structural steel and defining a plurality of bends, corrugations, indents, and apertures within the sheet to form a blank. For a cylindrical type storage container having a radially extending roof, the blanks are typically trapezoidal in shape. The bends, corrugations, indents, and apertures can be stamped, embossed, pressed and/or cut using conventional methods know to those skilled in the art. Generally, any cutting and stamping of the material for defining the apertures occurs prior to the embossment or shaping of the indents. This may substantially reduce the likelihood of stress cracks or material tears that may otherwise occur due to the material stretching when the embossing or shaping procedure takes place. A plurality of the blanks are then shaped and formed into identical individual roof support members, each having first and second spaced-apart rail members integrally connected by a center panel member.

The assembly process includes overlapping adjacent roof support members 200 in a 180 degree relationship to one another and aligning the rail members 202 to form a plurality of enclosures, or structural stiffeners 120', defined between adjacent center panel members 204 as best shown in FIG. 14. The overlapping adjacent roof support members 200 may define a continuous, meandering, exterior roof surface 156 exposed to the ambient environment. Each enclosure 120' may be formed having opposed outer and inner wall portions 202A, 202B oriented at an angle relative to the center panel 204. The outer and inner wall portions include the plurality of indents 206, vents 210 and apertures 214 that are configured for providing fluid communication between an interior of a structure 100 and the ambient environment. Respective fastening indents 226 of adjacent rail members may then be aligned with one another and adjacent roof support members 200 are secured together so that the embossed portions, or planar connecting sites 208 directly contact against each other to provide the spacing between the adjacent rail members. As previously discussed, the roof support members 200 can be fastened to one another using conventionally available mechanical fasteners 216. In other aspects, the indents 206 may be provided with cooperating interlocking members that are configured to secure the adjacent rail members against relative movement.

The foregoing discussion discloses and describes merely exemplary arrangements of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A granular bin roof support system having a plurality of interconnected radial support members defining at least a portion of a roof, each support member comprising:

a trapezoidal shaped monolithic sheet of structural metal formed having first and second spaced-apart rail members radially extending and integrally connected by a center panel member, each rail member comprising a plurality of indents formed therein and projecting from each rail member, wherein rail members of adjacent support members cooperate to overlap with one another such that indents of neighboring support members are aligned to project toward each other and to contact each other to space the rail members from each other and at least some of the indents are fastened together, forming a radially extending structural stiffener.

2. A granular bin roof support system according to claim 1, wherein a plurality of the indents each define at least one venting aperture therein.

3. A granular bin roof support system according to claim 1, wherein the indents comprise at least one of a generally frusto-pyramidal and frusto-conical shape.

4. A granular bin roof support system according to claim 1, wherein the center panel member comprises a plurality of corrugations.

5. A granular bin roof support system according to claim 1, wherein the center panel members of the plurality of interconnected radial support members cooperate to define a continuous, meandering, exterior roof surface.

6. A granular bin roof support system according to claim 1, wherein the radially extending structural stiffener comprises an inner wall and an outer wall each wall having at least two rows of spaced apart indents with venting apertures, the inner wall indents defining downwardly facing apertures and the outer wall indents defining upwardly facing apertures.

7. A granular bin roof support system according to claim 1, wherein the rail members are formed and oriented at an angle of between about 90 to about 110 degrees relative to the center panel member.

8. A granular bin roof support system according to claim 1, wherein each of the plurality of indents comprises at least one venting aperture and the interconnected radial support members are substantially similar in shape to each other.

9. A radial roofing system comprising:

a granular storage bin having an upper rim;

a plurality of individual radial roof support members configured to rest adjacent the upper rim, each radial roof support member being formed from a folded, monolithic sheet of structural metal and having:

a first rail member having a first plurality of indents projecting from the first rail member;

a second rail member having a second plurality of indents projecting from the second rail member; and a center panel disposed between the first rail member and the second rail member, wherein adjacent roof support members are arranged such that a plurality of the respective first and second pluralities of indents of neighboring rail members project toward each other to contact each other to space the rail members from each other and are fastened together, forming a structural stiffener therebetween, the structural stiffeners radially extending a length of the roof support members.

10. A radial roofing system according to claim 9, wherein a plurality of the indents define at least one venting aperture therein.

11. A radial roofing system according to claim 9, wherein the plurality of roof support members are substantially similar in shape to each other.

12. A radial roofing system according to claim 9, further comprising a plurality of mechanical fasteners for securing the respective indents of neighboring rail members to one another.

13. A radial roofing system according to claim 9, further comprising a support rod circumferentially disposed about the exterior of the roofing system and attached to a plurality of structural stiffeners via a plurality of bracket members secured to the indents of the rail members.

14. A radial roofing system according to claim 9, wherein the structural stiffeners comprise:

an inner wall portion facing an interior of the granular storage bin;

an outer wall portion facing an exterior of the granular storage bin; and a base portion for supporting the structural stiffener on the upper rim and configured to direct moisture to an exterior of the granular storage bin.

15. A radial roofing system according to claim 14, further comprising a plurality of mounting brackets configured to secure the structural stiffeners to the grain bin such that the base portion is adjacent the upper rim.

16. A method of constructing a radial roofing system, the method comprising:

providing a unitary flat sheet of structural steel;

defining a plurality of apertures and indents within the sheet to form a blank;

shaping and forming a plurality of blanks into a plurality of substantially identical roof support members having first and second spaced apart rail members integrally connected by a center panel member;

overlapping adjacent roof support members in a 180 degree relationship to one another and aligning the rail members to form a plurality of enclosures defined between adjacent center panel members, each enclosure comprising opposed outer and inner wall portions oriented at an angle relative to the center panel, the outer and inner wall portions comprising the plurality of indents and apertures configured for providing fluid communication between an interior of a structure and the ambient environment; and aligning respective indents of adjacent rail members with one another and securing at least some of the plurality of indents of adjacent roof support members together.

17. A method according to claim 16, wherein securing adjacent roof support members comprises mechanically fastening the indents to one another with a mechanical fastener.

18. A method according to claim 16, wherein defining a plurality of apertures and indents within the sheet comprises cutting out the plurality of apertures prior to shaping the indents.

19. A method according to claim 16, wherein overlapping adjacent roof support members comprises creating a continuous, meandering, exterior roof surface.

20. A method according to claim 16, further comprising forming and orienting the rail members at an angle of between about 90 to about 110 degrees relative to the center panel member.

* * * * *